US006949876B2

(12) United States Patent
Kugo et al.

(10) Patent No.: US 6,949,876 B2
(45) Date of Patent: Sep. 27, 2005

(54) GLASS MEMBER FOR CATHODE RAY TUBE

(75) Inventors: Teruaki Kugo, Otsu (JP); Yukihiro Nagamatsu, Otsu (JP); Michiharu Eta, Otsu (JP)

(73) Assignee: Nippon Electric Glass Co., Ltd., Shiga-ken (JP)

( * ) Notice: Subject to any disclaimer, the term of this patent is extended or adjusted under 35 U.S.C. 154(b) by 232 days.

(21) Appl. No.: 10/424,547

(22) Filed: Apr. 24, 2003

(65) Prior Publication Data

US 2003/0214220 A1 Nov. 20, 2003

(30) Foreign Application Priority Data

Apr. 26, 2002 (JP) ..... 2002-126574

(51) Int. Cl.[7] ..... H01J 31/00

(52) U.S. Cl. ..... 313/477 R; 313/493; 313/634

(58) Field of Search ..... 313/495, 512, 313/634, 477 R, 461, 482, 476, 493; 65/68; 220/2.1 A, 2.1 R; 445/22, 25, 45

(56) References Cited

U.S. PATENT DOCUMENTS 3,593,874 A * 7/1971 Powell ..... 220/2.1 A
3,623,196 A * 11/1971 Bongenaar et al. ..... 445/8
6,509,683 B2 * 1/2003 Lee ..... 313/477 R
6,667,570 B2 * 12/2003 Kim et al. ..... 313/477 R
6,693,374 B2 * 2/2004 Tho et al. ..... 313/477 R
2003/0151349 A1 * 8/2003 Jung ..... 313/477 R

FOREIGN PATENT DOCUMENTS

| | | |
|---|---|---|
| JP | 42-20557 | 10/1977 |
| JP | 43-7608 | 3/1978 |
| JP | 60-177453 | 11/1985 |

* cited by examiner

*Primary Examiner*—Karabi Guharay
*Assistant Examiner*—German Colón
(74) *Attorney, Agent, or Firm*—J.C. Patents

(57) ABSTRACT

A glass member for use in a cathode ray tube is provided, which can facilitate the heating and softening of glass during sealing and raise the productivity without decreasing the mechanical strength of the product by improving the shapes of the seal end faces of the panel and funnel. In an edge area between an edge of the seal end face of each side part of the glass member for use in the cathode ray tube comprising a glass panel or a funnel and a position about 5 mm away along a tube axis from the edge, a thin edge part is formed to have a thickness decreasing part. The rate of thickness decreasing thereof toward the edge is larger than that of a standard shape in a root area adjacent to the edge area. Also, the thin edge part is formed so that an inequality of $0.3 \leqq t_1/t_0 \leqq 0.7$ is satisfied where $t_1$ is a thickness at a position 1 mm away along the tube axis from the edge, and $t_0$ is a thickness at a position 5 mm away along the tube axis from the edge.

19 Claims, 9 Drawing Sheets

GLASS MEMBER FOR CATHODE RAY TUBE

BACKGROUND OF THE INVENTION

1. Field of the Invention

The present invention relates to glass members for use in the cathode ray tube including a glass panel, glass funnel and glass bulb for TV sets and the like, and particularly to a glass panel and a glass funnel having improved shapes in their seal ends and therearound.

2. Description of the Related Art

Referring now to FIGS. 10 and 11, the conventional cathode ray tube has a glass panel 1*x*' (hereinafter simply referred to "panel"), a glass funnel 1*y*' (hereinafter simply referred to "funnel"), and a neck tube 11*y*' fused to the smaller opening of the funnel 1*y*', as major glass members.

The panel 1*x*' has a face part 2*x*' having an effective plane on which images are to be displayed, and a skirt part 4X' surrounding the face part 2*x*' and standing at almost right angles via a blend R part 3*x*' at the peripheral edge of the face part 2*x*'. The skirt part 4*x*' has side parts 6*x*' connected at four corner pats 5*x*', and a seal end face 7*x*' is formed at the opening end of each side part 6*x*' for connection with the funnel 1*y*'.

Meanwhile, the funnel 1*y*' of a funnel-like shape has a yoke part 3*y*' having a small opening end 2*y*' to which the neck tube 11*y*' is to be fused, and a body part 4*y*' integral with the yoke part 3*y*'. The body part 4*y*' has side parts 6*y*' connected at four corner parts 5*y*', and a seal end face 7*y*' is formed at the large opening end of each side part 6*y*' for connection with the panel 1*x*'.

The panel 1*x*' and the funnel 1*y*' are molded by putting a lump of high-temperature molten glass called glass gob in a female mold consisting of a bottom mold and a shell mold and then pushing a male mold (plunger mold) thereon to press and develop the lump of the molten glass. When the lump of the molten glass is molded into a predetermined shape, the plunger mold is lifted and the glass molded article is appropriately cooled and solidified. After the shell mold is removed, the glass molded article, namely the panel 1*x*' or funnel 1*y*' is released from the bottom mold.

During this process, with respect to the seal end faces 7*x*' and 7*y*' of the panel 1*x*' and the funnel 1*y*' and their peripheries, their outer walls and seal end faces are shaped by the concave portion of the shell mold, while their inner walls are shaped by the convex portion of the plunger mold. For easy removal from the shell mold and plunger mold after molding, the peripheries of the seal end faces 7*x*' and 7*y*' are shaped to become slightly thinner to the top edge from mold match lines Mx' and My', which correspond to the mating faces-between the shell mold and the bottom mold (see FIG. 12).

After the panel 1*x*' and the funnel 1*y*' thus formed go through subsequent prescribed treatments, their seal end faces 7*x*' and 7*y*' are fused together and thereby a glass bulb (hereinafter simply referred to "bulb") for a cathode ray tube (CRT) is provided. In the bulb, necessary components are installed to complete a cathode ray tube, and the tube is evacuated to keep a high vacuum.

As the methods for fusing the panel 1*x*' and the funnel 1*y*' together, it is common that the seal end faces 7*x*' and 7*y*' are heated up and softened, and then directly mated together for fusion. It is also a common practice to use frit glass (solder glass) in between the seal end faces 7*x*' and 7*y*' for fusion.

Projector-use cathode ray tubes and monochrome-use cathode ray tubes do not need internal members such as a shadow mask or aperture grill that are essential in the direct-view type color cathode ray tube. Thus, particularly when manufacturing bulbs for projector-use cathode ray tubes and monochrome-use cathode ray tubes, the seal end faces 7*x*' and 7*y*' are heated with burners and softened and then directly pushed onto each other for easy, cost-saving fusion.

Now the details of the peripheral shape of each seal end face 7*x*', 7*y*' of the panel 1*x*' or the funnel 1*y*' will be described with reference to FIG. 12. Thickness $t_1$' of the glass, for instance, 1 mm away along the tube axis from the top of the seal end face 7*x*', 7*y*' is slightly smaller than thickness T' of the glass at mold matching line Mx', My' on the side part 6*x*', 6*y*' of the skirt 4*x*' or the body 4*y*'. In fact, $t_1$' is substantially equal to T'.

This is a result of the need to meet a requirement that the mold design should be easy or simple while maintaining the easiness of glass release from the shell mold and plunger mold after molding.

However, under a recent need for increased productivity, if the seal end faces 7*x*' and 7*y*' have the peripheral shapes like those shown in FIG. 12, the productivity per unit time cannot be raised when manufacturing bulbs by fusing the panel 1*x*' and the funnel 1*y*'.

When the panel 1*x*' and the funnel 1*y*' are heated to soften the seal end faces 7*x*' and 7*y*', the heat provided by burners and the like propagates from a surface near the seal end face 7*x*' and 7*y*' to the inside. The glass is heated up and softened when an appropriate amount of heat has been conveyed. As shown in FIG. 12, if the glass thickness is substantially the same from mold match line Mx', My' to the seal end face 7*x*', 7*y*', it takes a long time for heat conduction and glass softening because the seal end face 7*x*', 7*y*' are thick. As a result, the productivity does not rise.

To avoid this problem, the glass extending from mold matching line Mx', My' to the seal end face 7*x*', 7*y*' should be made thin. However, if the glass is simply made thin, a strength problem may arise because the bulb is evacuated to keep a high vacuum. Thus there is a limit to thinning of the glass wall to maintain mechanical strength.

In detail, as disclosed in Japanese Patent Publication No. Sho 43-7608, it has been a common practice probably with no exception to make the rate of decreasing thickness of glass extending from mold match lines Mx', My' to the seal end faces 7*x*', 7*y*' equal or almost equal to that of glass on the top side (side of the seal end faces 7*x*', 7*y*'). Namely, if easiness in mold release after molding and in mold design is considered, the rate of decreasing glass thickness toward the top side must be constant or almost constant, and the above conventional shape has been regarded as the standard design shape.

As a result, if the thickness of a target glass portion is to be made thin, the rate of decreasing glass thickness toward the top side has been made constant or almost constant over the entire range. Then the glass particularly on the top side becomes too thin, and a strength problem may arise as described above.

BRIEF SUMMARY OF THE INVENTION

The present invention has been made to solve those problems, and a technical object of the invention is to raise productivity by improving the peripheral shape of the seal end face of the panel and funnel, so that the glass may be heated and softened easily during sealing while posing no strength problem.

According to a first aspect of the invention made to achieve the above technical objects, there is provided a glass member for use in a cathode ray tube comprising a glass panel including a substantially rectangle face part and a skirt part having a seal end face at its opening end and side parts integral with a peripheral edge of the face part at almost right angles via a blend R part, wherein in an edge area between an edge of the seal end face of each side part and a position about 5 mm away from the edge along a tube axis, a thin edge part is formed to have a thickness decreasing part of which rate of thickness decreasing toward the edge is larger than that of a standard shape in a root area adjacent to the edge area.

In the above description, "the position about 5 mm away" means the position 5±1 mm or 5±2 mm away. Also "standard shape" is a shape, as described with reference to FIG. 12, determined from the viewpoint considering easy mold release after molding and easy mold design. This is also a shape of a constant or almost constant rate of thickness decreasing toward the edge from the mold matching line.

The above configuration is invented because, when the panel is fused with the funnel by heating and softening the periphery of the panel seal end, their connection boundary between the region losing the original shape and that holding the original shape, or the position by which the thickness of the product (bulb) after fusion is examined is 5 mm away from the seal end face.

According to the above configuration, over a prescribed area between the edge of the seal end face of each side part and the position about 5 mm away along the tube axis from the edge, such a thin edge part is formed that has a thickness decreasing part of which rate of thickness decreasing toward the edge is larger than that of the standard shape in the root area adjacent to the prescribed area. Thus, particularly the end of the thin edge part in the prescribed area becomes significantly thinner than that of the standard shape. When the panel is fused with the funnel, the heated and softened thin edge part is deformed to be almost as thick as the end of the standard shape area, while the area of the standard shape hardly causes deformation accompanying crush due to softening by heating. In detail, since the thin edge part is relatively thin, it easily softens in a short time when heated by a burner or the like, while the area of the standard shape which is relatively thick does not soften but hold the original shape when the burner heat has reached from the thin edge part. The thin edge parts help to easily use the panel with the funnel in a short time. After fusion, the product has a sufficiently high strength because the fused connection becomes almost as thick as the standard shape. As a result, the productivity can be efficiently improved while avoiding the fall of strength in the panel, particularly near the periphery of each side part of the skirt part.

In order to achieve the above-mentioned technical object, according to a second aspect of the present invention, there is provided a glass member for use in a cathode ray tube comprising a glass panel including a face part and a skirt part similar to those described above, wherein a thin edge part is formed so that an inequality of $0.3 \leqq t_1/t_0 \leqq 0.7$ is satisfied where $t_1$ is a thickness at a position 1 mm away along a tube axis from an edge of the seal end face of each side part of the skirt part, and $t_0$ is a thickness at a position 5 mm away along the tube axis from the edge of the seal end face. In this case, the area extending from the position about 5 mm away from the edge to the mold match line should have the abovementioned standard shape.

Specifically, as shown in FIG. 12 illustrating the conventional glass member, if the shape extending from the position 5 mm away from the edge toward the edge is equal to that extending toward the edge from the standard shape area, the thickness at the position 1 mm away from the edge becomes close to 100% of the thickness at the position 5 mm away. In contrast, in the invention, since thickness $t_1$ at the position 1 mm away is set at 30–70% of thickness $t_0$ at the position 5 mm away, the area between the edge and the position 5 mm away therefrom is appropriately thin. Then for the same reason as pointed out in the first aspect, the panel is easily fused with the funnel in a short time, and the panel strength does not decrease even after using. If $t_1/t_0<0.3$ holds, the edge near the seal end face becomes too thin and the difference in thickness from the other portions of the skirt part becomes large. Then, since the area near the seal end face alone is excessively cooled during panel molding, cracks and chips are likely to occur. On the other hand, if $t_1/t_0>0.7$ holds, the edge near the seal end face does not become thin enough. Thus when the seal end face is heated by a burner or the like, heat conduction to the inside becomes poor, and the time for softening and fusing becomes inappropriately long. If $t_1/t_0$ lies in the above range, such problems do not arise. In view of the foregoing, if $0.4 \leqq t_1/t_0 \leqq 0.6$ holds, such problems can be prevented with higher probability.

In order to achieve the above technical objects, according to a third aspect of the present invention, there is provided a glass member for use in a cathode ray tube comprising a glass funnel including a yoke part having a small opening end to which a neck tube is to be fused and a body part having a seal end face at its large opening end and side parts integral with the yoke part, wherein in an edge area between an edge of the seal end face of each side part and a position about 5 mm away along a tube axis from the edge, a thin edge part is formed to have a thickness decreasing part of which rate of thickness decreasing toward the edge is larger than that of a standard shape in a root area adjacent to the edge area.

The meanings of "the position about 5 mm away" and "standard shape" have already been described in the first aspect. For the same reasons as pointed out for the panel referred to in the first aspect, if the fennel of this configuration is employed, the conventional problem that the strength of the funnel decreases can be prevented, and the productivity can be efficiently improved.

In order to achieve the above-mentioned technical objects, according to a fourth aspect of the present invention, there is provided a glass member for use in a cathode ray tube comprising a glass funnel including a yoke part and a body part similar to those described above, wherein a thin edge part is formed so that an inequality of $0.3 \leqq t_1/t_0 \leqq 0.7$ is satisfied where $t_1$ is a thickness at a position 1 mm away along a tube axis from an edge of the seal end face of each side part, and $t_0$ is a thickness at a position 5 mm away along the tube anus from the edge of the seal end face. Also in this case, the area extending from the position about 5 mm away from the edge to the mold match line should have the abovementioned standard shape.

Then for the same reason as pointed out in the second aspect of the panel, if the funnel of this configuration is employed, the funnel is easily fused with the panel in a short time, and the funnel strength does not decrease even after fusing. The reasons for $0.3 \leqq t_1/t_0 \leqq 0.7$ and preferably $0.4 \leqq t_1/t_0 \leqq 0.6$ are the same as those described above.

When connecting the seal end face of the panel to that of the funnel, it is preferable not to use frit glass in between them but to contact their thin edge parts to each other with pressure after heating and softening the thin edge parts.

In the above configuration, it is preferable that the thin edge part of the panel or funnel has a thickness decreasing part of which outer wall is a flat or almost flat plane slanting in accordance with the gradually decreasing thickness, and the slanting angle $\alpha$ of the outer wall against the plane parallel to the tube axis meets an inequality of $30° \leqq \alpha \leqq 50°$.

In this configuration, since the thin edge part has a thickness decreasing part of which rate of thickness decreasing toward the edge lies in an appropriate range, the heating and softening of the thin edge parts during the fusion of the panel and the funnel is appropriately carried out; and the sealing process can be simplified and completed in a shorter time. In this case, if $\alpha<30°$ holds, since the thin edge part has a shape similar to the standard shape, when the thin edge part is heated up to a prescribed temperature, the temperature of the area of the standard shape on the root side rises. This makes it difficult to ensure the shape of the seal part during fusion between the panel and the funnel. Meanwhile, if $\alpha>50°$ holds, when burner flames, for example, are directed to the thin edge part in the direction normal to the tube axis for heating and softening, the edge of the thickness decreasing part is too much distant from flames or the flames are not blown to the outer wall at right angles, whereas the edge of the thickness decreasing part is located in an appropriate position against the flames. Then it becomes difficult to conduct uniform and highly efficient heating with burners. If slanting angle $\alpha$ is set at a value in the above range, those problems are less likely to arise.

In the above configuration, at the edge of the thickness decreasing part, a seal end part should continuously be formed so as to have a flat or almost flat outer wall of a slanting angle smaller than the slanting angle $\alpha$ and have the seal end face at the end.

Under this configuration, the burner flames directed to the thin edge part in the direction normal to the tube axis do not escape on the outer wall of the thickness decreasing part but appropriately stay on the outer wall of the seal end part of which slanting angle is smaller than that of the outer wall of the thickness decreasing part. Then since the seal end part is appropriately heated intensively by the flames and the heat from the seal end part quickly reaches the thickness decreasing part continuously formed with the seal end part, the entire thin edge part is heated and softened in whole in a short time.

Slanting angle $\beta$ of the outer wall of the seal end part against the plane parallel to the tube axis should be set so that an inequality of $5° \leqq \beta<\alpha$ is satisfied.

Under this configuration, when burner flames are blown to the thin edge-part, since the flame incident angle against the outer wall of the seal end part becomes close to the right angle, the heat of flames is efficiently provided to the seal end part, and the thin edge part is appropriately heated and softened in a short time. Then if $\beta<5°$ holds, the draft for mold release of the panel or funnel becomes small, and mold defects such as friction flaws are likely to arise when the molded product is released from the mold. In contrast, if $\beta>\alpha$ holds, the flames are blown onto the outer wall of the seal end part almost parallel thereto, and the heat of flames is not provided to the wall efficiently. In addition, since the outer wall of the seal end part becomes distant from flames and the seal end part is not sufficiently heated, the probability of seal failure may become high. If slanting angle $\beta$ is set at a value in the above range, those problems are less likely to arise.

In the above configuration, the thin edge part should be formed in each side part excluding portions in the vicinity of the corner part.

As described in detail later, when the seal ends of the panel and funnel are heated and softened by burners, a plurality of burners are arrayed at predetermined intervals around the seal ends of the panel and funnel, and the panel and funnel are turned around the tube axis. Since the seal ends of the panel and funnel are substantially rectangle, the corner parts come closest to the burners when turned around the tube axis. Compared with the center of each side part, the portions in the vicinity of the corner part receives more heat from burner flames. As a result, if one tries to sufficiently heat the areas other than the corner parts of the side parts, the corner parts are heated excessively and softened more than necessary, and the seal end in each corner part may fall inward. Then the portions in the vicinity of the corner parts cannot be fused successfully. In the invention, therefore, no thin edge part is formed in the vicinity of the corner part, and the seal end at the portions in the vicinity of the corner part is made relatively thick to enlarge the heat capacity of the corner part. Then if the heat provided by burners to the portions in the vicinity of the corner part is more than that provided to the other parts, now that the portions in the vicinity of the corner part are thick and heat capacity thereof is large enough to trade off such difference in the amount of given heat, the seal end face extending over the entire circumference of the side parts including the portions in the vicinity of the corner parts is uniformly heated and softened, and thus the fusion process can be carried out successfully. In this case, in order to prevent wrinkles and cracks during molding and to ensure excellent moldability, the continuing portions toward the corner parts of the thin edge part may be configured such that the thin edge part is made to become gradually narrow toward the corner part and finally disappear.

Furthermore, in the above configuration, the end of each side part in the vicinity of the corner part should project beyond the ends of the other portions of the side part.

In general, the outer surface of the face part of this type panel is polished after the molding process has been completed. During this polishing process, the panel is placed on a work table with its face part up, and a polisher is pulled down onto the outer surface of the face part. If all the edges of the side parts including corner parts are almost flush, in other words, if all the edges contact the top surface of the work table, loads for polishing are dispersed to these contact areas, and the contact force per unit area on the work table becomes small. Then the panel is likely to rattle, and it becomes difficult to polish the panel smoothly. In the invention, the end of each side part in the vicinity of the corner part is made to project beyond the ends of the other portions of the side part, so that the panel contacts the work table only at the portions in the vicinity of the corner parts. Then since the contact force per unit area is augmented, the panel does not rattle easily. Also when a funnel is placed on a work table with its small opening end up for various treatments, only the portions in the vicinity of the corner parts on the large opening side contact the top face of the work table, and the funnel can be secured on the table. In this case as well, the portions in the vicinity of the corner parts should be smoothly, continuously formed with the other portions of the side part to prevent wrinkles and cracks during molding and ensure an excellent moldability. In case of the funnel, the ends of the portions in the vicinity of the corner parts and those of the thin edge parts may be flush or almost flush.

A glass bulb for use in a cathode ray tube is manufactured by fusing a seal end face of a panel with a seal end face of a funnel. Then the bulb may be manufactured from a panel configured as above and a funnel not configured as above, or the bulb may be manufactured from a panel not configured as above and a funnel configured as above. Alternatively, the bulb may be manufactured from a panel configured as above and a funnel configured as above. In this manner, a high-quality bulb comprising a panel and a funnel well fused to each other can be provided.

DETAILED DESCRIPTION OF THE INVENTION

Figure 1:
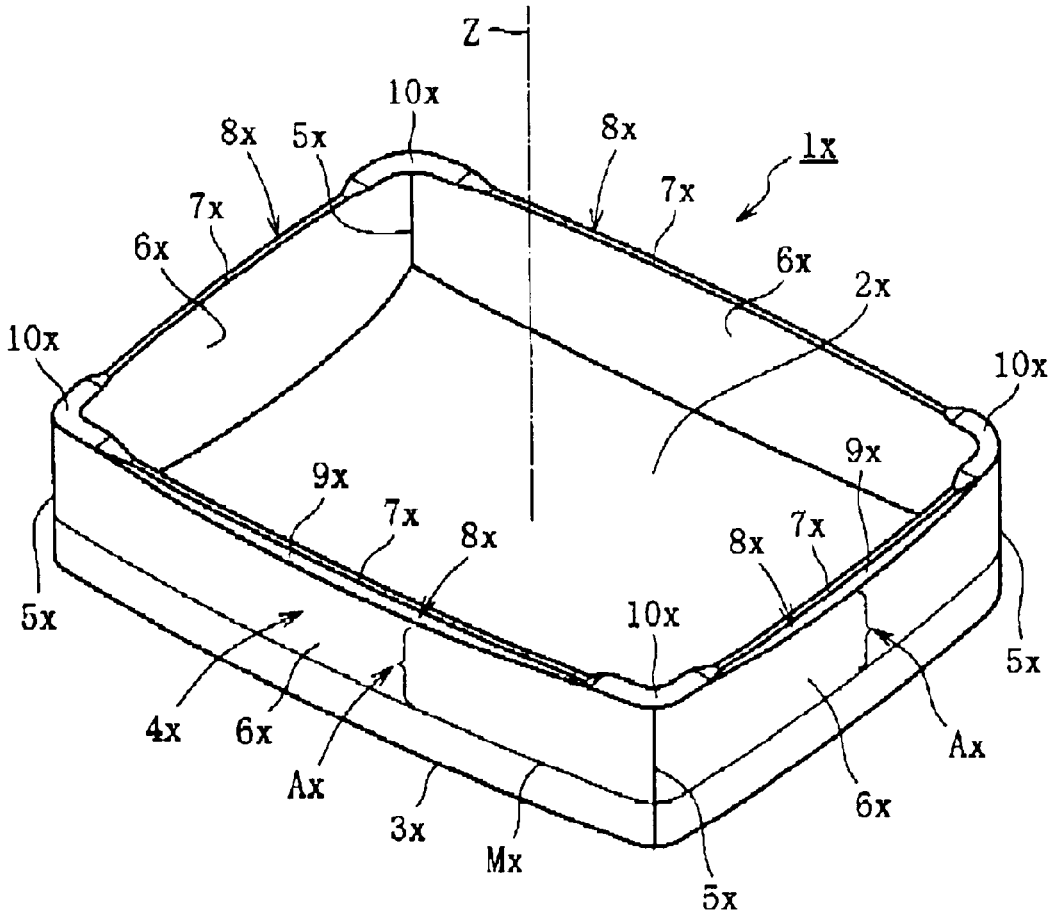
FIG. 1 is a perspective view showing a panel that is a glass member for a cathode ray tube according to a first embodiment of the invention.
Figure 2:
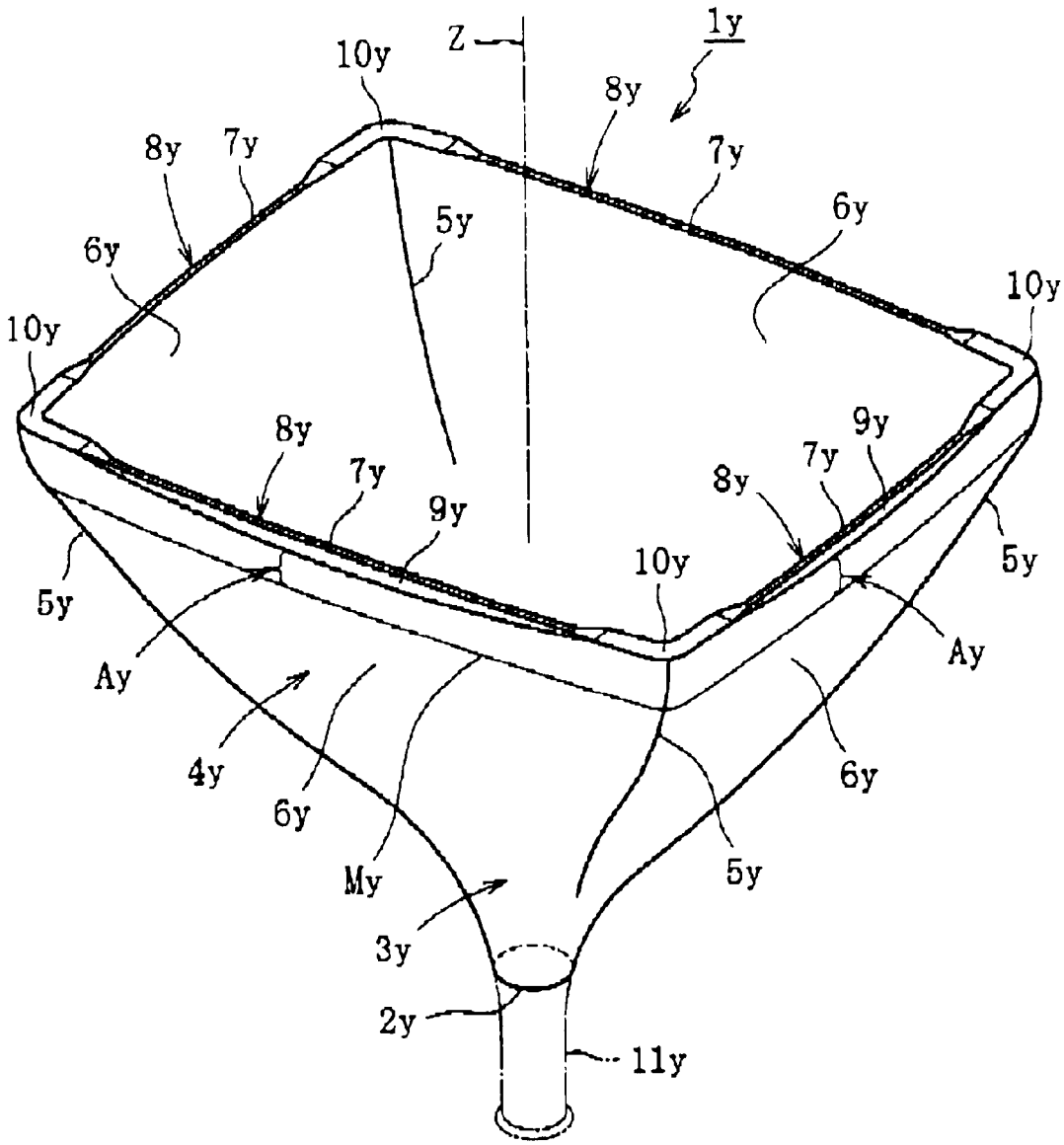
FIG. 2 is a perspective view showing a funnel that is a glass member for a cathode ray tube according to the first embodiment of the invention.

Now an embodiment of the invention will be described with reference to the accompanying drawings. FIG. 1 is a perspective view illustrating the panel that is the glass member for the cathode ray tube of the embodiment, and FIG. 2 is a perspective view illustrating the funnel that is the glass member for the cathode ray tube of the embodiment.

As shown in FIG. 1, a panel 1*x* has a face part 2*x* having an effective plane on which images are to be displayed, and a skirt part 4*x* that stands at almost right angles at the peripheral edge of the face part 2*x* to surround the face part 2*x* via a blend R part 3*x*. The skirt part 4*x* has side parts 6*x* connected to each other at four corner parts 5*x*. At the opening end of these side parts 6*x*, a seal end face 7*x* that is to be connected to the funnel 1*y* is formed. The panel 1*x* (also the funnel 1*y* that will be described later) in this embodiment is a glass bulb constituting member of the projector-use cathode ray tube or the monochrome-use cathode ray tube.

The periphery near the seal end face 7*x* of each side part 6*x* constituting the skirt part 4*x* of the panel 1*x* has a thin edge part 8*x* in the prescribed area extending from the edge of the seal end face 7*x*. This thin edge part 8*x* has a thickness decreasing part 9*x* of which decreasing rate in thickness toward the edge is larger than that of area Ax of the side part 6*x* (of the standard shape) lying on the root side adjacent to the prescribed area and on the side toward edge from a mold matching line Mx.

This thin edge part 8*x* is formed in each side part 6*x* excluding portions in the vicinity of the corner part 5*x*. As a result, the portions in the vicinity of the corner part 5*x* extends toward the edge, keeping the standard shape, with the thickness being kept almost constant or at a constant or almost constant thickness decreasing rate. The end face 10*x* of the portion in the vicinity of each corner part 5*x* is formed to project upward (toward the edge) beyond the thin edge part 8*x*.

Meanwhile, referring now to FIG. 2, the funnel 1*y* of a funnel-like shape has a yoke part 3*y* having a small opening end 2*y* to which the neck tube 11*y* is to be fused, and a body part 4*y* integral with the yoke part 3*y*. The body part 4*y* has side parts 6*y* connected with each other at four corner parts 5*y*, and a seal end face 7*y* is formed at the large opening end of these side parts 6*y* for connection with the panel 1*x*. The funnel 1*y* may be formed by fusing a neck tube 11*y* to its small opening 2*y*, or otherwise may not have a neck tube 11*y*.

Also in the periphery near the seal end face 7*y* of each side part 6*y* constituting the body part 4*y* of the funnel 1*y*, a thin edge part 8*y* is formed in the prescribed area extending from the edge of the seal end face 7*y*. This thin edge part 8*y* has a thickness decreasing part 9*y* of which decreasing rate in thickness toward the edge is larger than that of area Ay of the side part 6*y* (of the standard shape) lying on the root side adjacent to the prescribed area and on the side toward edge from a mold matching line My.

This thin edge part 8*y* is formed in each side part 6*y* excluding portions in the vicinity of the corner part 5*y*. As a result, portions in the vicinity of the corner part 5*y* extends toward the edge, keeping the standard shape, with the thickness being kept almost constant or at a constant or almost constant thickness decreasing rate. The end face 10*y* of the portion in the vicinity of each corner part 5*y* is formed to project upward (toward the edge) beyond the thin edge part 8*y*. Designated Z in FIGS. 1 and 2 represents the center axis, namely tube axis, of the panel 1*x* or the funnel 1*y*.

Now the shapes of the thin edge parts 8*x* and 8*y* of the panel 1*x* and the funnel 1*y* as well as the shapes of the portions in the vicinity of the corner parts 5*x* and 5*y* will be described below in detail. Since they have substantially the same shape, the shape of either of the thin edge parts or either of the portions in the vicinity of the corner parts will be referred to in FIGS. 3–6. For simplicity throughout those figures, the corner parts 5*x*, 5*y* are denoted by 5, the side parts 6*x*, 6*y* are denoted by 6, the seal end faces 7*x*, 7*y* are denoted by 7, the thin edge parts 8*x*, 8*y* are denoted by 8, the thickness decreasing parts 9*x*, 9*y* are denoted by 9, the end faces 10*x*, 10*y* in the vicinity of the corner parts are denoted by 10, mold match lines Mx, My are denoted by M, and standard shape areas Ax, Ay are denoted by A.

Figure 3:
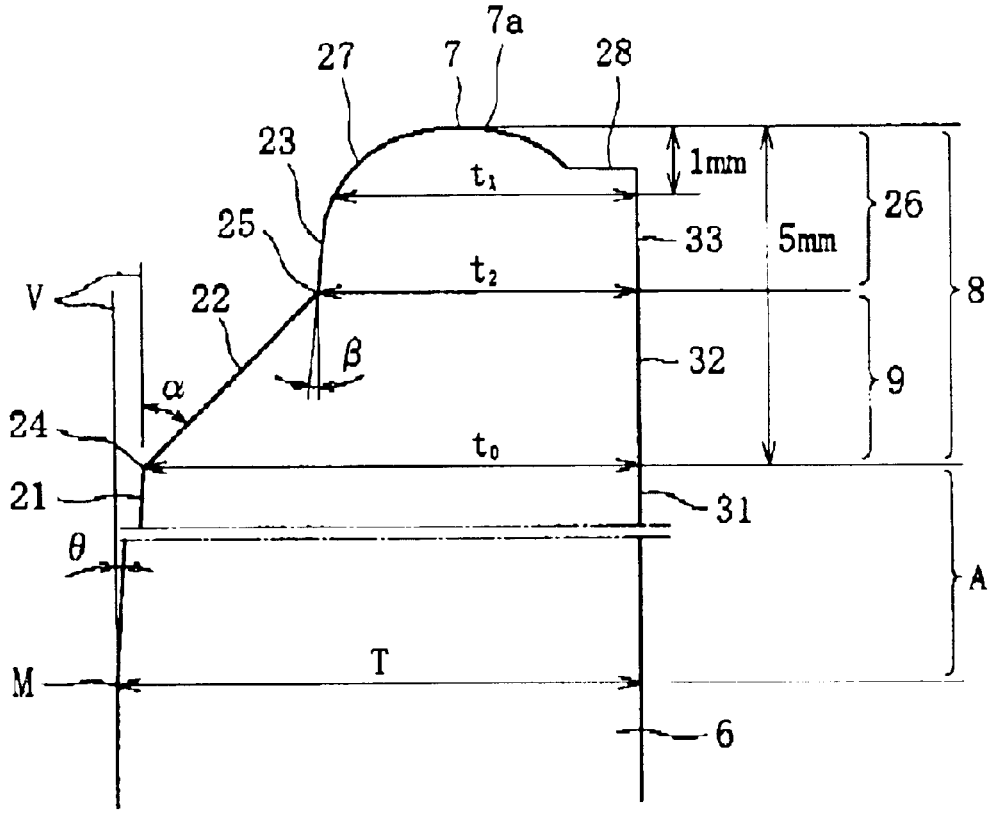
FIG. 3 is a vertical front sectional view schematically showing the major parts of the side part of the panel and funnel according to the first embodiment of the invention.

As shown in FIG. 3, each side part 6 has an area A of the standard shape extending from the mold match line M toward the edge. This area A is designed in accordance with the requirements for easy mold release of the side part 6 during molding and easy manufacturing of molds. Thus the thickness of standard shape area A slightly decreases toward the edge at a constant or almost constant rate with no sudden change in thickness. In detail, a first outer wall 21 of the area A (left-hand in the figure) slants slightly as much as θ, for example, 1–5° inwardly (right-hand in the figure) against plane V parallel to the tube axis Z, while a first inner wall 31 of the area A slants slightly, for example 1–10°, outwardly against the plane V parallel to the tube axis Z.

At the end of the area A, a thin edge part 8 is formed which is thinner than thickness $t_0$ at the end of the standard shape. This thin edge part 8 has a thickness decreasing part 9 that is continuous from the end 24 of the area A of the standard shape and has a thickness decreasing rate toward to the edge larger than that of the standard shape. The thin edge part 8 has also a seal end part 26 that is continuous to the end 25 of the thickness decreasing part 9 and has a thickness decreasing rate smaller than that of the thickness decreasing part 9.

In details a second outer wall 22 of the thickness decreasing part 9 slants inwardly at angle α larger than θ that is the slanting angle of the first outer wall 21 against the plane V parallel to the tube axis Z. A second inner wall 32 of the thickness decreasing part 9 slightly slants as much as or almost as much as the first inner wall 31. The slanting angle α is set to fall in the range, $30° \leqq \alpha \leqq 50°$, preferably $40° \leqq \alpha \leqq 50°$, in this embodiment, it is set at 45 degrees. The edge 24 of the first outer wall 21 at the boundary between the first outer wall 21 and the second outer wall 22 is an arc of a curvature radius of, for example, 0.5–1.5 mm and leads to the second outer wall 22.

A third outer wall 23 on the outer face of the seal end part 26 slants inward slightly as much as β, which is smaller than a of the second outer wall 22, against the plane V parallel to the tube axis Z. A third inner wall 33 on the inner face of the seal end part 26 slants slightly as much as or almost as much as the first, second inner walls 31, 32 do. The slanting angle β is set so that $5° \leqq \beta < \alpha$, preferably $5° \leqq \beta \leqq 15°$; β is set at 10° in this embodiment. The edge 25 of the second outer wall 22 at the boundary between the second outer wall 22 and the third outer wall 23 is an arc of a curvature radius of, for example, 0.5–1.0 mm and continuous to the third outer wall 23. At the top of the seal end part 26, a seal end face 7 that is upwardly convex is formed, and this seal end face 7 is continuous to the third outer wall 23 via the curvature face 27. The seal end face 7 may be formed by an arc of a single curvature radius, or the curvature extending from the seal end face 7 to the curvature face 27 may be formed by an arc of a single curvature radius.

In the area between the edge 7*a* of the seal end face 7 and a position about 5 mm away from the edge 7*a* toward the root side along the tube axis, the thin edge part 8 is formed that has the thickness decreasing part 9 and the seal end part 26. The thin edge part 8 is formed so that thickness $t_1$ at the position 1 mm away toward the root side along the tube axis from the edge 7*a* of the seal end face 7 and thickness $t_0$ at the position 5 mm away from the edge 7*a* of the seat end face 7 have a relationship, $0.3 \leqq t_1/t_0 \leqq 0.7$, preferably $0.4 \leqq t_1/t_0 \leqq 0.6$. In the area from the inside end of the seal end face 7 to the top edge of the side part 6, 0.5–0.8 mm downward along the tube axis Z from the edge 7*a* of the seal end face 7, a substantially horizontal flat face 28 is formed. Thickness $t_0$ at the position 5 mm away from the edge is smaller approximately by 0.2–1 mm than thickness T at mold match line M. Thickness $t_2$ at the top of the thickness decreasing part 9 is 50–70% of thickness $t_0$ at the position 5 mm away from the edge.

Figure 4:
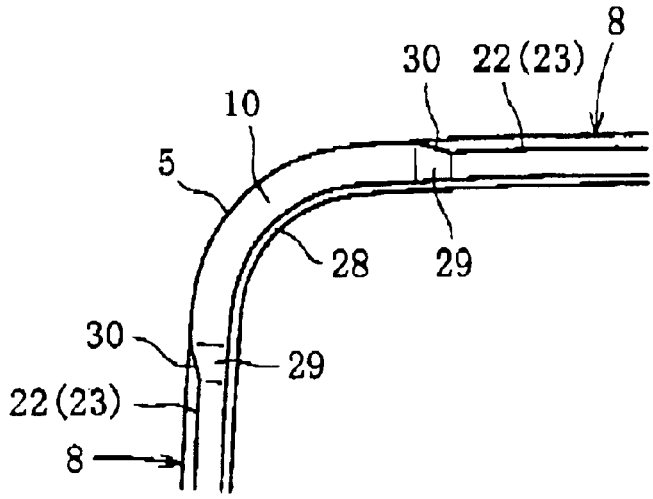
FIG. 4 is a schematic plan view showing the major parts of the side parts of the panel and funnel according to the first embodiment of the invention.

As shown in FIG. 4, the thin edge part 8 configured as above is formed in the portions in each side part 6 excluding the portions in the vicinity of the corner parts 5 as described before. The flat face 28 inside the seal end face 7 is however formed in all the circumference of the side parts 6 including the portions in the vicinity of the corner parts 5. The end face 10 in the vicinity of the corner part 5 and the seal end face 7 of the thin edge part 8 are smoothly connected to each other via a gentle slope 29. As the second, third outer walls 22, 23 are continuous to the portions in the vicinity of the corner part 5 via the gentle slope face 30, the thin edge part 8 becomes thicker toward the corner 5.

Figure 5A:
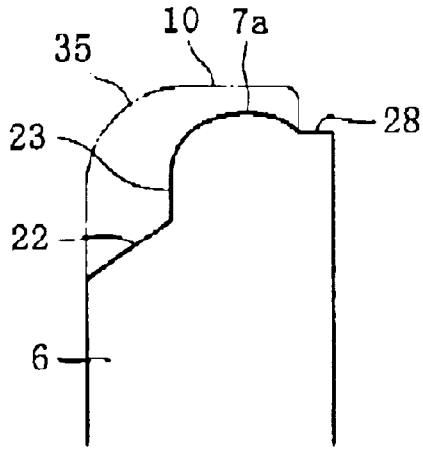
FIGS. 5A, 5B and 5C are vertical front sectional views showing geometric relations between the corner part of each side part and the other portions thereof in three ways.
Figure 5B:
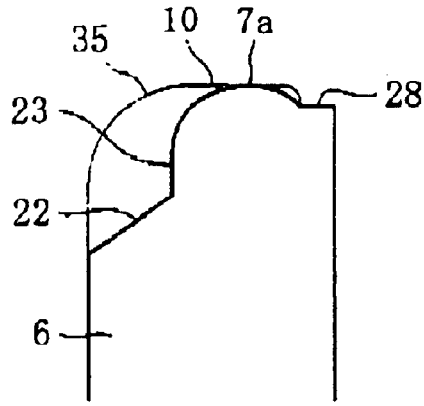
Figure 5C:
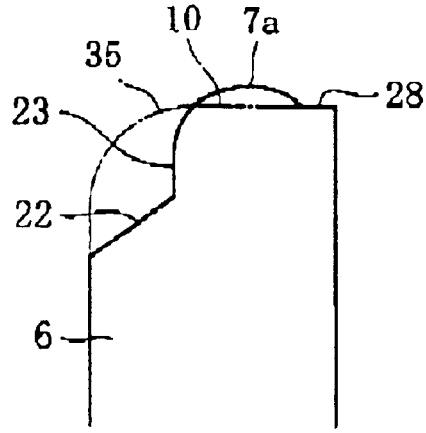

In detail, as shown in FIG. 5A in this embodiment, the outer face of the end face 10 in the vicinity of the corner part 5 is a curvature face 35 of a single curvature radius, while projecting beyond the edge 7*a* of the seal end face 7 of the thin edge part 8, for example, as long as about 0.5–2.0 mm. Alternatively, as shown in FIG. 5B in a first variation, the end face 10 in the vicinity of the corner part 5 may be as high as or approximately as high as the edge 7*a* of the seal end face 7 of the thin edge part 8. Otherwise, as shown in FIG. 5C in a second variation, the edge 7*a* of the seal end face 7 of the thin edge part 8 may project beyond the end face 10 in the vicinity of the corner part 5, for example, as long as about 0.5–2.0 mm.

Figure 6:
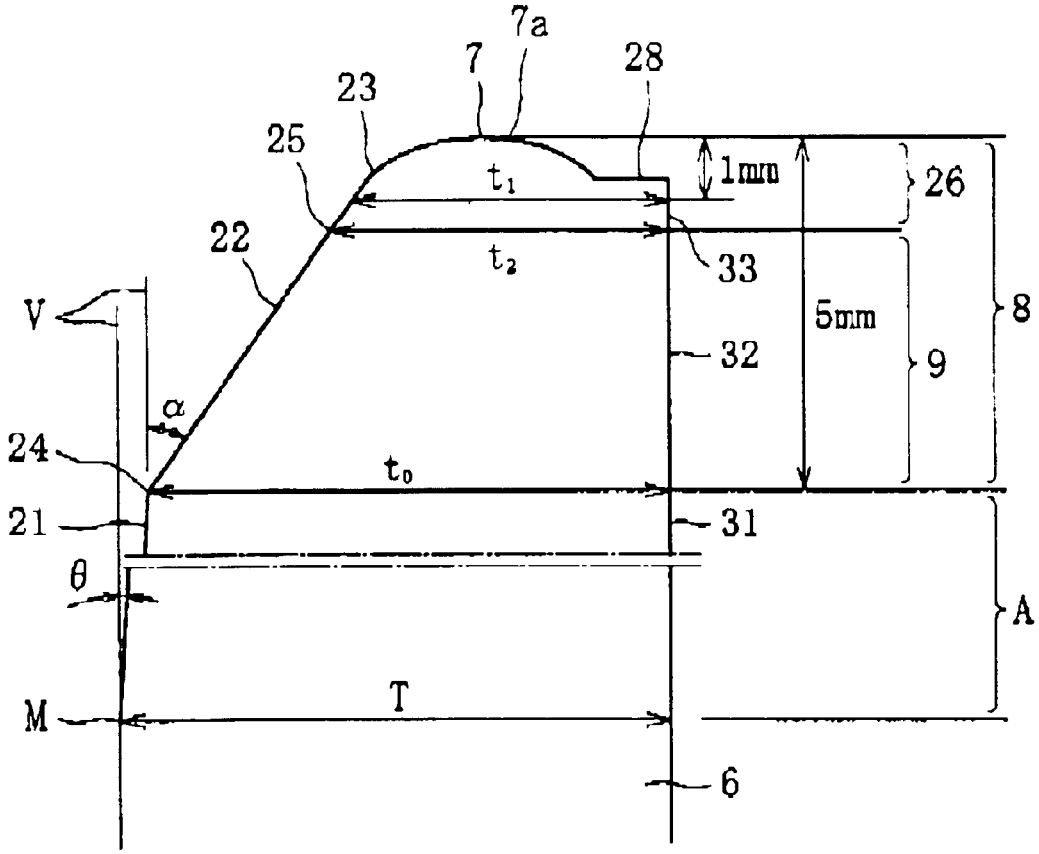
FIG. 6 is a vertical front sectional view schematically showing the major parts of the side part of the panel and funnel according to a second embodiment of the invention.

FIG. 6 is a diagram illustrating the major parts of the side part 6 of the panel 1*x* and the funnel 1*y* according to a second embodiment of the invention. In FIG. 6, the same members as those of the first embodiment have the same numerals, and their explanation is not repeated.

The side part 6 of the second embodiment differs from that of the first embodiment in that the end 25 of the second outer wall 22 of the thickness decreasing part 9 of which thickness decreasing rate toward the end is constant or almost constant is located near the seal end face 7 and the second outer wall 22 is smoothly connected to the seal end face 7 via the third outer wall 23, and that slanting angle α of the second outer wall 22 against the plane V parallel to the tube axis Z is set so that $30° \leqq \alpha \leqq 40°$, specifically 35°. Therefore, it is the same as the first embodiment in that thickness $t_1$ at the position 1 mm away to the root side from the edge 7*a* of the seal end face 7 and thickness $t_0$ at the position 5 mm away from the edge 7*a* of the seal end face 7 have a relationship, $0.3 \leqq t_1/t_0 \leqq 0.7$, preferably $0.4 \leqq t_1/t_0 \leqq 0.6$.

Figure 7:
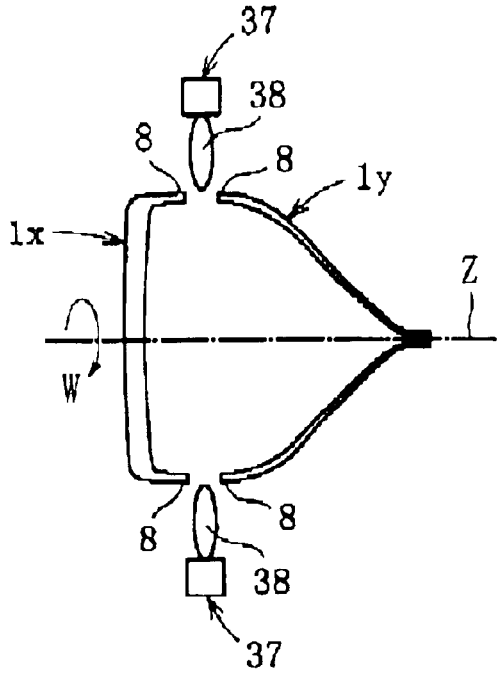
FIG. 7 is a vertical sectional side view schematically showing the process of sealing the panel and the funnel according to the individual embodiments of the invention.
Figure 8:
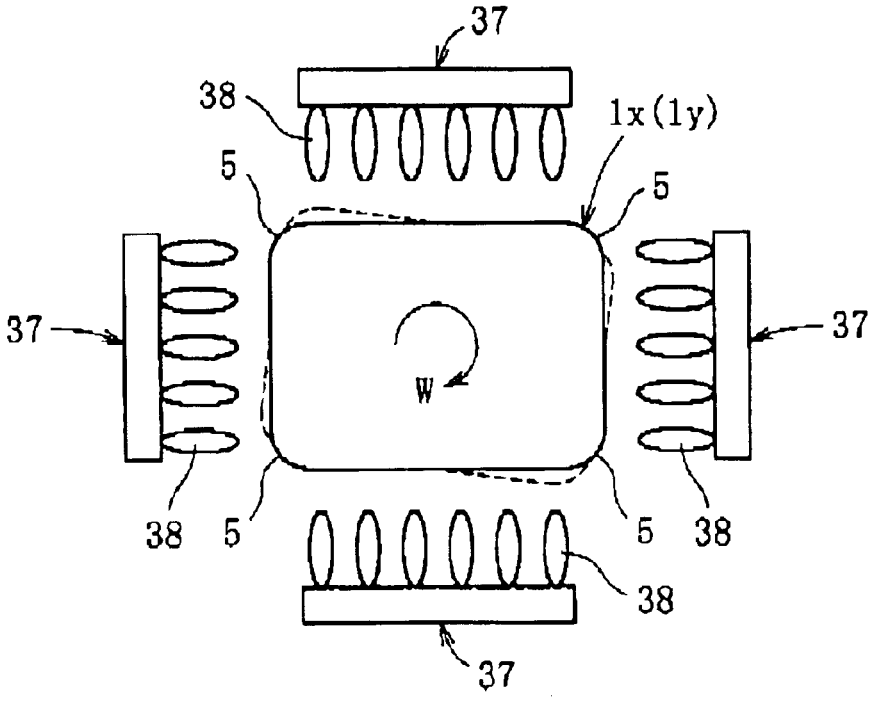
FIG. 8 is a schematic front view showing the process of sealing the panel and funnel according to the individual embodiments of the invention.

The panel 1*x* and the funnel 1*y* of the above first and second embodiments are fused together, as shown in FIGS. 7 and 8. Specifically, four burners 37 are arranged in a rectangular configuration (see FIG. 8) so that they surround the outside of the four side parts 6, and the flames 38 of the burners 37 heat and soften the thin edge parts 8 of the side parts 6 of the panel 1*x* and the funnel 1*y* (see FIG. 7). During heating, the panel 1*x* and the funnel 1*y* rotate around the tube axis Z as shown by the arrow W.

According to this heating method, since the seal end faces 7 of the panel 1*x* and the funnel 1*y* are almost rectangle, when they are turned around the tube axis Z, the corner parts 5 of the side parts 6 come closest to the flames 38 of burners 37. Thus, compared with the center of each side part 6, the corner part 5 is more heated by flames 38. Since the thin edge part is not formed in the portions in the vicinity of the corner parts as described above, the thickness of the seal end face 7 at the corner part 5 and its vicinity is relatively large, and therefore the heat capacity of the portions in the vicinity of the corner parts 5 is relatively large. As a result, even when the heat provided by flames 38 to the portions in the vicinity of the corner parts 5 is larger than that provided to the side part 6 excluding the corner part 5, since the thickness and heat capacity of the portions in the vicinity of the corner 5 are so large as to trade off the difference in the amount of given heat, the seal end face 7 can be uniformly heated and softened over all the circumference of the side parts 6 including the corner parts 5 and vicinities thereof.

Particularly in the first embodiment, the slanting angle β of the third outer wall 23 of the seal end part 26 is small and close to zero. Thus when flames 38 blow the thin edge part 8, flames 38 are incident at almost right angles upon the third outer wall 23 of the seal end part 26. As a result, the heat of flames 38 can be provided to the seal end part 26 with minimum loss, and therefore the heating and softening of the thin edge parts 8 is appropriately performed in a short time.

Figure 9:
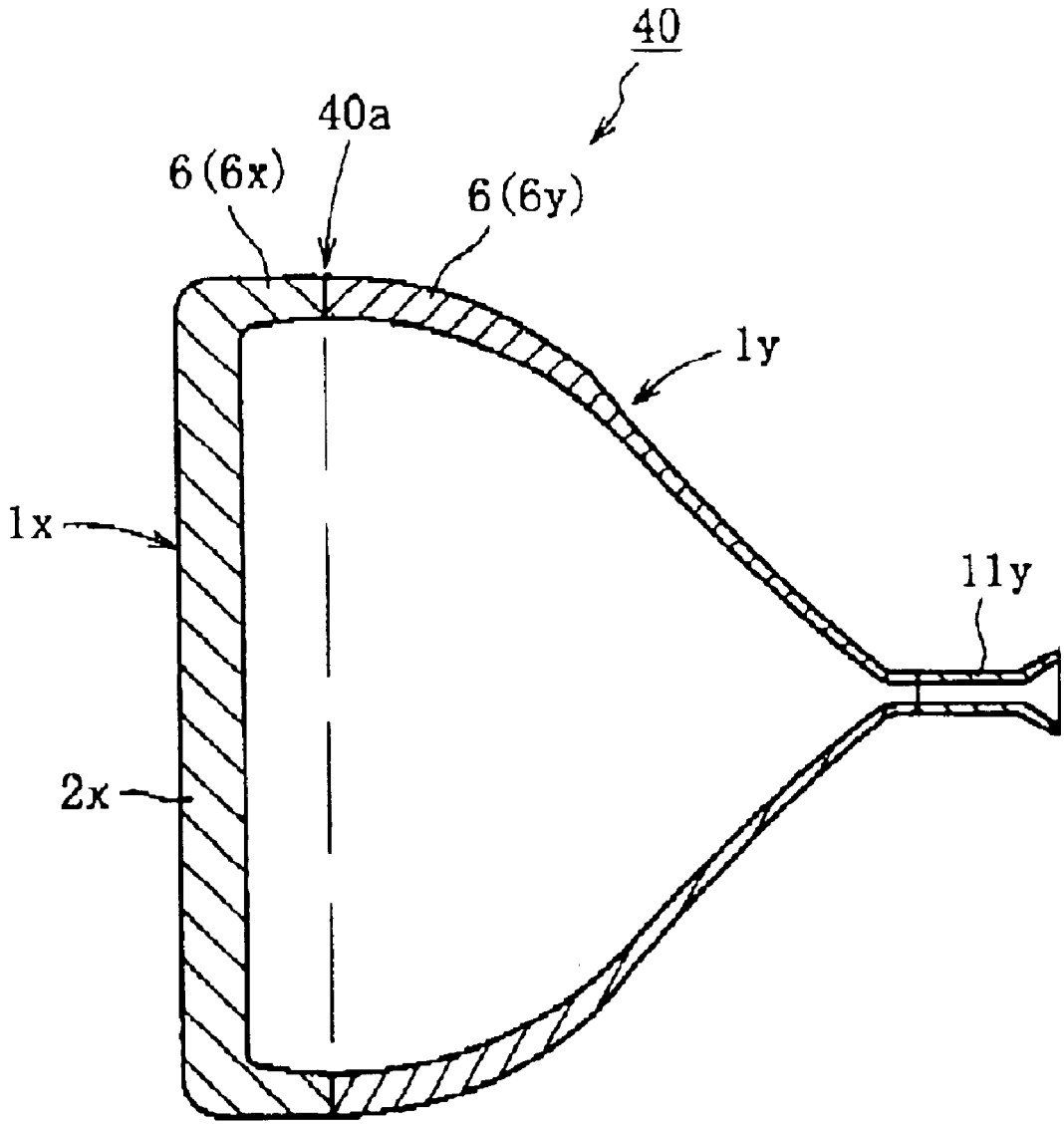
FIG. 9 is a vertical sectional side view schematically showing the glass bulb for use in the cathode ray tube according to another embodiment of the invention.
Figure 10:
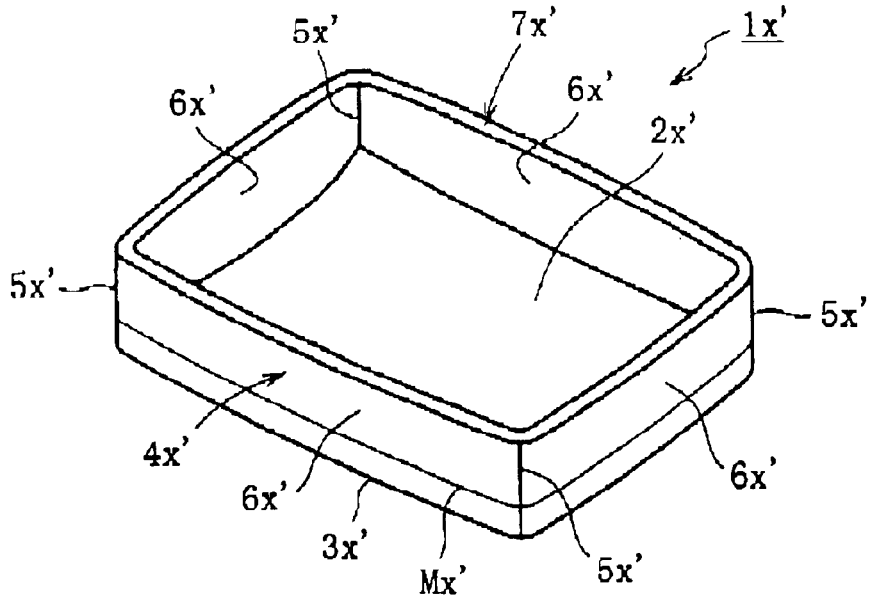
FIG. 10 is a perspective view showing a conventional panel.
Figure 11:
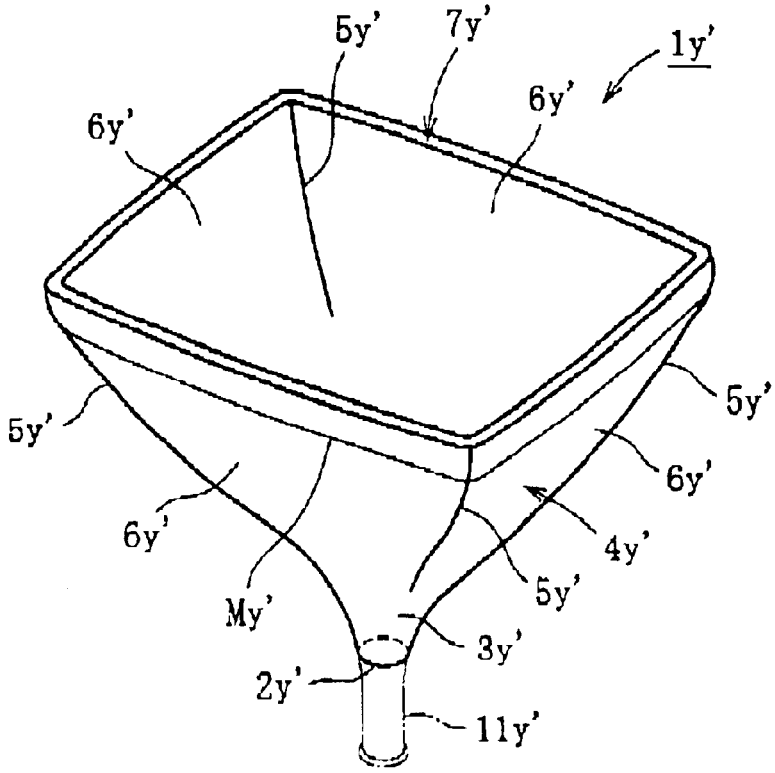
FIG. 11 is a perspective view showing a conventional funnel.
Figure 12:
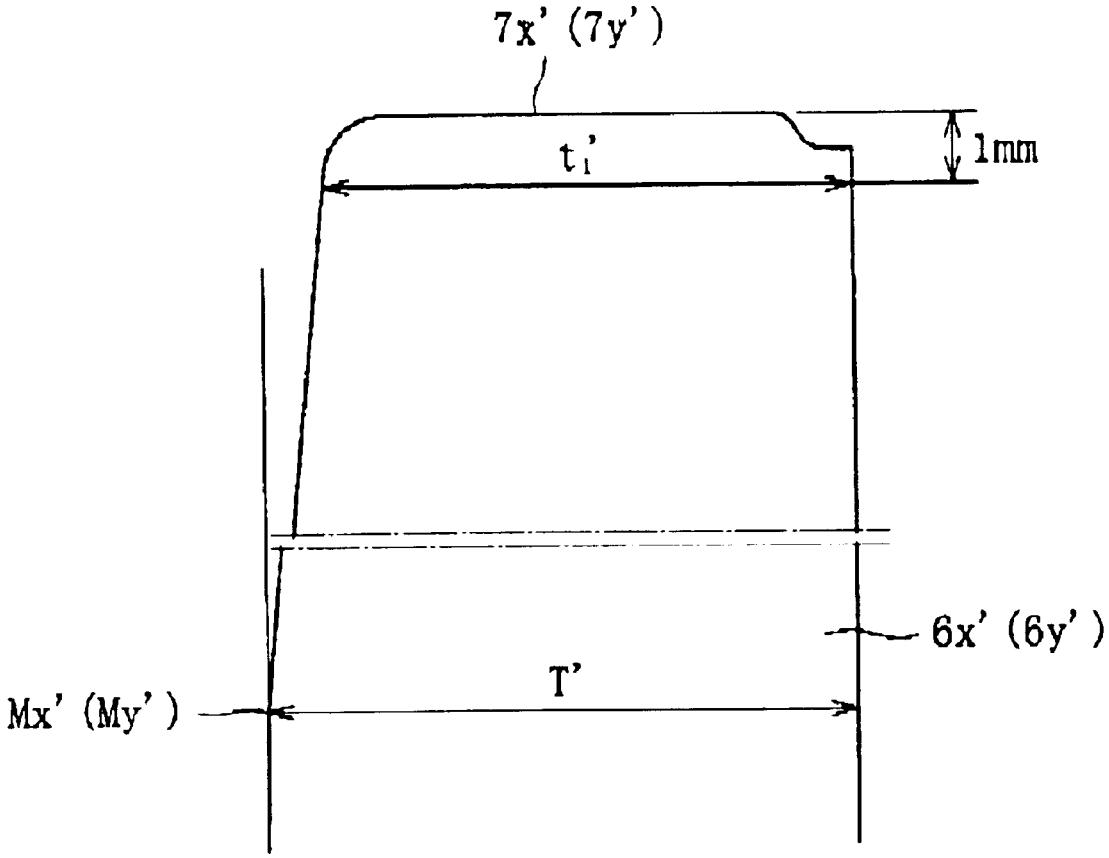
FIG. 12 is a vertical front sectional view showing the major parts of the side part of the conventional panel and funnel.

The heated panel 1*x* and the funnel 1*y* are contacted and fused to each other in their thin edge parts 8 to provide a glass bulb 40 for a cathode ray tube, as shown in FIG. 9. In the course of this fusing connection, since the thin edge part 8 becomes gradually thinner toward its end, it is sufficiently heated and softened, and thus the using connection is easily completed in a short time. The thickness of the used connection 40*a* is kept at $t_0$, which is the thickness at the position 5 mm away from the seal end face 7 of the thin edge part 8, and thus the strength of the side parts 6 and eventually the glass bulb 40 is ensured. In addition, since the fused connection 40*a* is subject to no polishing or grinding, the strength of the bulb 40 becomes larger, compared with that subject to such processes.

According to the invention, in an edge area between an edge of the seal end face of each side part of the CRT-use glass member comprising a panel or a funnel and a position about 5 mm away from the edge along a tube axis, a thin edge part is formed to have a thickness decreasing part of which rate of thickness decreasing toward the edge is larger than that of a standard shape in a root area adjacent to the edge area. Then, particularly the end of the thin edge part becomes significantly thinner than that in the area of the standard shape. When this thin edge part is heated with a burner or the like, it easily softens in a short time. On the other hand, in the area of the standard shape which is relatively thick, when the heat from the burner has reached there, it does not easily soften and maintains the original shape. By virtue of this thin edge part, it becomes possible to fuse the panel with the funnel in a short time, and after fusion a sufficiently high strength is ensured because the connected area is approximately as thick as the standard shape area. As a result, the productivity can be efficiently raised while avoiding the problem that the strength of the edge of each side part falls.

According to the present invention, a thin edge part is formed so that an inequality of $0.3 \leqq t_1/t_0 \leqq 0.7$ is satisfied where $t_1$ is a thickness at a position 1 mm away along a tube axis from an edge of the seal end face of each side part of the skirt part, and $t_0$ is a thickness at a position 5 mm away along the tube axis from the edge of the seal end face. Then the vicinity of the seal end becomes appropriately thin, and for the same reason as the above the panel can be easily fused with the funnel in a short time. At the same time, decrease in the panel strength after sealing can advantageously be prevented.

If the thin edge part of the panel or funnel has a thickness decreasing part of which outer wall is a flat or almost flat plane slanting in accordance with the gradually decreasing thickness, and the slanting angle α of the outer wall against the plane parallel to the tube axis meets an inequality of $30° \leqq \alpha \leqq 50°$, the thin edge part is appropriately heated and softened by a burner or the like when the panel is fused to the funnel, and the sealing process is simplified and completed in a shorter time.

If a seal end part is continuously formed at the edge of the thickness decreasing part so as to have a flat or almost flat outer wall of a slanting angle smaller than the slanting angle α and have the seal end face at the end, the flames directed to the thin edge part in the direction normal to the tube axis do not escape on the outer wall of the thickness decreasing part but appropriately stay on the outer wall of the seal end part of which slanting angle is smaller than that of the outer wall of the thickness decreasing part. Then since the seal end part is appropriately heated by flames and the heat from the seal end part quickly reaches the thickness decreasing part, the end of the entire thin edge part is heated and softened in a short time, and the fusing process is carried out more efficiently.

If slanting angle β of the outer wall of the seal end part against the plane parallel to the tube axis is set so that an inequality of $5° \leqq \beta < \alpha$ is satisfied, the draft for mold release of the panel or funnel becomes an appropriate value, and the probability of causing friction flaws during release from the mold can be lowered. At the same time, the flame incident angle against the outer wall of the seal end part can be set at an appropriate value, and heat can be received from flames efficiently.

In the invention, the thin edge part is formed in each side part excluding portions in the vicinity of the corner part. If the heat provided by burners to the portions in the vicinity of the corner parts is more than that provided to the other portions, since the portions in the vicinity of the corner parts is thick and heat capacity thereof is large enough to trade off such difference in the amount of given heat, the seal end face extending over the entire circumference of the side parts including the portions in the vicinity of the corner parts is uniformly heated and softened, and thus the fusion process can be carried out successfully.

Furthermore, if the end of each side part in the vicinity of the corner part is made to project beyond the ends of the other portions of the side parts, the contact force at the portions in the vicinity of the corner parts is augmented when the panel or funnel is mounted on a work table, for example. Then such a glass member can be seated firmly, and the panel, for example, can be smoothly polished with no rattle.

If a glass bulb for use in the cathode ray tube is manufactured from the panel and/or funnel of the above structures, it makes a high-quality final product with no strength problems in the connection.

What is claimed is:

1. A glass member for use in a cathode ray tube comprising a glass panel including a substantially rectangular face part and a skirt part having a seal end face at its opening end and side parts integral with a peripheral edge of the face part at almost right angles via a blend R part, wherein in an edge area between an edge of the seal end face of each side part and a position about 5 mm away from the edge along a tube axis, a thin edge part is formed to have a thickness decreasing part of which rate of thickness decreasing toward the edge is larger than a thickness decreasing rate of a standard shape toward the edge, wherein the standard shape is another part of the side part, adjacent to a root of the thickness decreasing part of the thin edge part, and having a constant or substantially constant thickness decreasing rate toward the edge capable of facilitating mold release and mold design of the side part.

2. The glass member for use in a cathode ray tube according to claim 1, wherein said thin edge part has a thickness decreasing part of which outer wall is a flat or almost flat plane slanting in accordance with a gradually decreasing thickness, and a slanting angle $\alpha$ of the outer wall against the plane parallel to the tube axis meets an inequality of $30° \leqq \alpha \leqq 50°$.

3. The glass member for use in a cathode ray tube according to claim 2, wherein, at the edge of said thickness decreasing part, a seal end part is continuously formed so as to have a flat or almost flat outer wall of a slanting angle smaller than said slanting angle $\alpha$ and have said seal end face at the end.

4. The glass member for use in a cathode ray tube according to claim 3, wherein a slanting angle $\beta$ of the outer wall of said seal end part against the plane parallel to the tube axis meets an inequality of $5° \leqq \beta < \alpha$.

5. The glass member for use in a cathode ray tube according to claim 1, wherein said thin edge part is formed in each side part excluding portions in the vicinity of the corner part.

6. The glass member for use in a cathode ray tube according to claim 5, wherein the end of each side part in the vicinity of the corner part projects beyond the ends of the other portions of the side part.

7. A glass member for use in a cathode ray tube comprising a glass panel including a substantially rectangular face part and a skirt part having a seal end face at its opening end and side parts integral with a peripheral edge of the face part at almost right angles via a blend R part, wherein a thin edge part is formed so that an inequality of $0.3 \leqq t_1/t_0 \leqq 0.7$ is satisfied where $t_1$ is a thickness at a position 1 mm away along a tube axis from an edge of the seal end face of each side part, and $t_0$ is a thickness at a position 5 mm away along the tube axis from the edge of the seal end face.

8. The glass member for use in a cathode ray tube according to claim 7, wherein said thin edge part has a thickness decreasing part of which outer wall is a flat or almost flat plane slanting in accordance with a gradually decreasing thickness, and a slanting angle $\alpha$ of the outer wall against the plane parallel to the tube axis meets an inequality of $30° \leqq \alpha \leqq 50°$.

9. The glass member for use in a cathode ray tube according to claim 7, wherein said thin edge part is formed in each side part excluding portions in the vicinity of the corner part.

10. A glass member for use in a cathode ray tube comprising a glass funnel including a yoke part having a small opening end to which a neck tube is to be fused and a body part having a seal end face at its large opening end and side parts integral with the yoke part, wherein in an edge area between an edge of the seal end face of each side part and a position about 5 mm away along a tube axis from the edge, a thin edge part is formed to have a thickness decreasing part of which rate of thickness decreasing toward the edge is larger than a thickness decreasing rate of a standard shape toward the edge, wherein the standard shape is another part of the side part, adjacent to a root of the thickness decreasing part of the thin edge part, and having a constant or substantially constant thickness decreasing rate toward the edge capable of facilitating mold release and mold design of the side part.

11. The glass member for use in a cathode ray tube according to claim 10, wherein said thin edge part has a thickness decreasing part of which outer wall is a flat or almost flat plane slanting in accordance with a gradually decreasing thickness, and a slanting angle $\alpha$ of the outer wall against the plane parallel to the tube axis meets an inequality of $30° \leqq \alpha \leqq 50°$.

12. The glass member for use in a cathode ray tube according to claim 11, wherein, at the edge of said thickness decreasing part, a seal end part is continuously formed so as to have a flat or almost flat outer wall of a slanting angle smaller than said slanting angle $\alpha$ and have said seal end face at the end.

13. The glass member for use in a cathode ray tube according to claim 12, wherein a slanting angle $\beta$ of the outer wall of said seal end part against the plane parallel to the tube axis meets an inequality of $5° \leqq \beta < \alpha$.

14. The glass member for use in a cathode ray tube according to claim 10, wherein said thin edge part is formed in each side part excluding portions in the vicinity of the corner part.

15. The glass member for use in a cathode ray tube according to claim 14, wherein the end of each side part in the vicinity of the corner part projects beyond the ends of the other portions of the side part.

16. A glass member for use in a cathode ray tube comprising a glass funnel including a yoke part having a small opening end to which a neck tube is to be fused and a body having a seal end face at its large opening end and side parts integral with the yoke part, wherein a thin edge part is formed so that an inequality of $0.3 \leqq t_1/t_0 \leqq 0.7$ is satisfied where $t_1$ is a thickness at a position 1 mm away along a tube axis from an edge of the seal end face of each side part, and $t_0$ is a thickness at a position 5 mm away along the tube axis from the edge of the seal end face.

17. The glass member for use in a cathode ray tube according to claim 16, wherein said thin edge part has a thickness decreasing part of which outer wall is a flat or almost flat plane slanting in accordance with a gradually decreasing thickness, and a slanting angle $\alpha$ of the outer wall against the plane parallel to the tube axis meets an inequality of $30° \leqq \alpha \leqq 50°$.

18. The glass member for use in a cathode ray tube according to claim 16, wherein said thin edge part is formed in each side part excluding portions in the vicinity of the corner part.

19. A glass member for use in a cathode ray tube comprising a glass bulb manufactured by fusing a seal end face of a glass panel and a seal end face of a glass funnel, wherein the glass member comprises both or either of a glass panel as set forth in any one of claims 1 to 9 and a glass funnel as set forth in any one of claims 10 to 18.

* * * * *